United States Patent [19]

Bouque et al.

[11] Patent Number: 5,050,902

[45] Date of Patent: Sep. 24, 1991

[54] SAFETY SKI BINDING

[75] Inventors: Jean-Michel Bouque, Cran-Gevrier; Jean-Claude Brischoux, Annecy-Le-Vieux, both of France

[73] Assignee: Salomon S.A., Annecy Cedex, France

[21] Appl. No.: 475,001

[22] Filed: Feb. 5, 1990

[30] Foreign Application Priority Data

Feb. 9, 1989 [FR] France ..... 89 01697

[51] Int. Cl.[5] ..... A63C 9/08; A63C 9/22

[52] U.S. Cl. ..... 280/629; 280/634

[58] Field of Search ..... 280/625, 629, 630, 633, 280/634

[56] References Cited

U.S. PATENT DOCUMENTS

| | | | |
|---|---|---|---|
| 3,778,076 | 12/1973 | Frisch | 280/629 |
| 3,893,685 | 7/1975 | Svoboda | 280/625 X |
| 4,372,574 | 2/1983 | Svoboda et al. | 280/634 |
| 4,398,747 | 8/1983 | Bernard et al. | 280/630 |
| 4,934,669 | 6/1990 | Bourdeau et al. | 267/122 |
| 4,940,253 | 7/1990 | Brischoux | 280/629 |

FOREIGN PATENT DOCUMENTS

| | | | |
|---|---|---|---|
| 368709 | 11/1982 | Austria . | |
| 2415957 | 8/1975 | Fed. Rep. of Germany . | |
| 2610841 | 8/1988 | France . | |
| 2610842 | 8/1988 | France | 280/629 |

*Primary Examiner*—Andres Kashnikow
*Assistant Examiner*—Brian L. Johnson
*Attorney, Agent, or Firm*—Sandler, Greenblum, & Bernstein

[57] ABSTRACT

A safety ski binding for holding a ski boot on a ski compensates for biases of violent but brief intensities. A shock absorber is located within a compression spring which presses against an adjustment nut. A rocking device transfers the movement of the shock absorber during a violent bias to the adjustment nut to cause additional compression of the spring. At least one hole is in the piston of the shock absorber to permit the passage of fluid during biases of weak intensities and to prevent the passage of the fluid during biases of violent but brief intensities.

23 Claims, 4 Drawing Sheets

Fig. 3
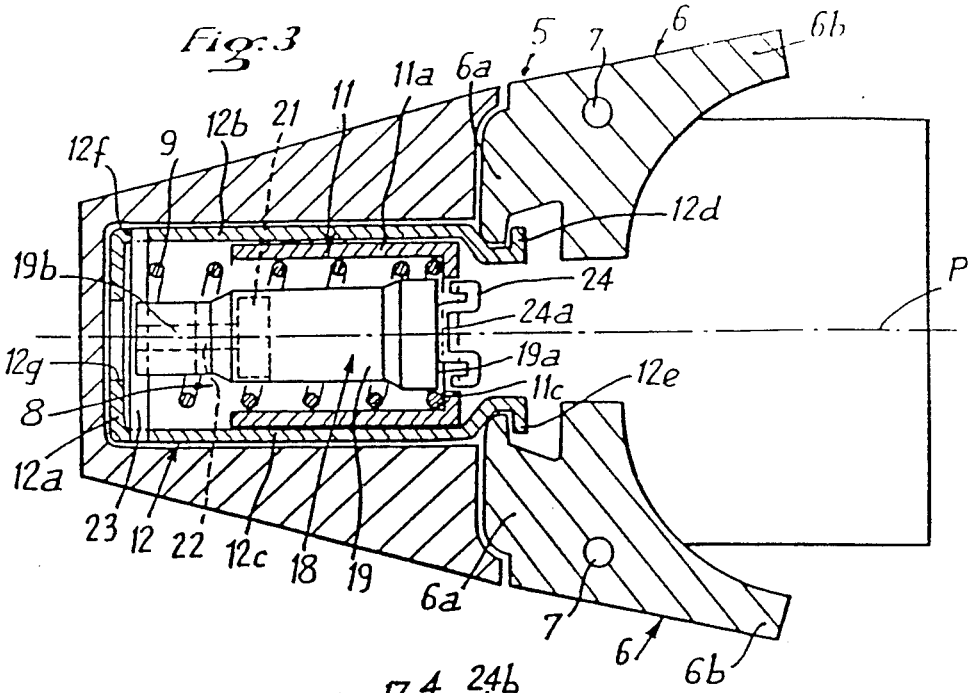
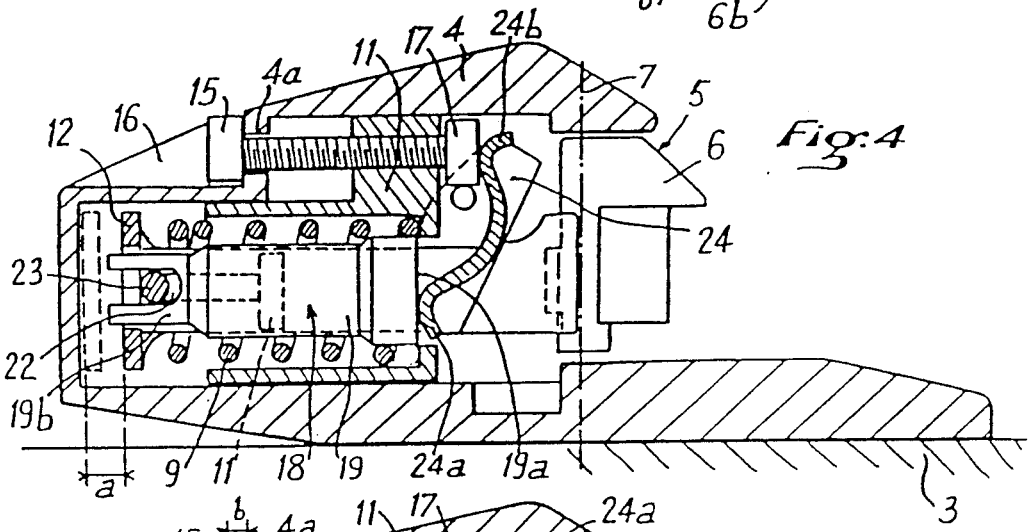
Fig. 4
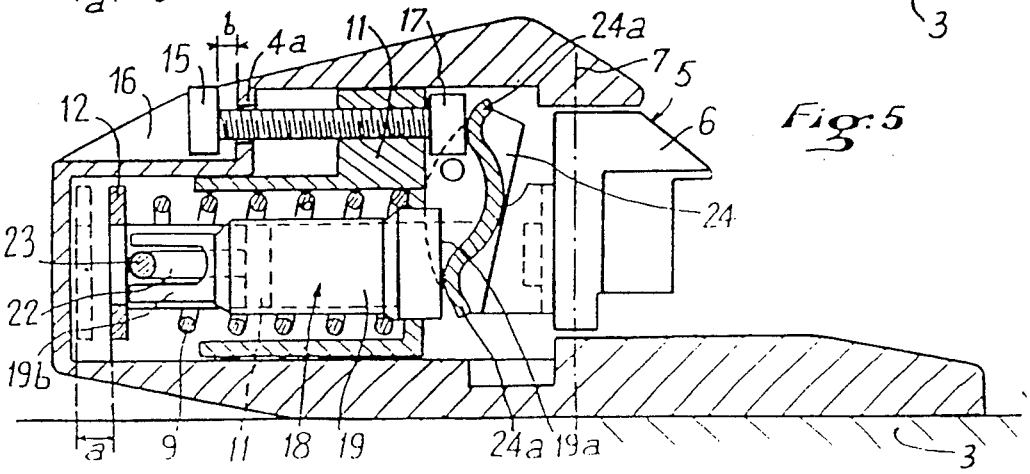
Fig. 5

SAFETY SKI BINDING

BACKGROUND OF THE INVENTION

1. Field of the Invention

The present invention relates to a safety ski binding adapted to hold the front of a boot on a ski.

2. Description of Background Information

Safety ski bindings of this type are called "front abutments", and include a body supporting in its rear part a jaw for holding the front of the boot. The jaw may be of the monoblock type or constituted of two independent lateral retention wings which are respectively journalled on the body about individual axes. Moreover, the body of the front abutment contains an energization mechanism for returning the jaw to the central locking position and which comprises a compression spring and a force transmission element, such as a tie rod or a sliding piston, which is inserted between the spring and the jaw. The spring rests at one of its ends on a support surface whose longitudinal position is adjustable by means of a screw for adjustment of the stiffness of the binding, and it acts through its other end on the force transmission element.

Front abutments of this type, in which the energization mechanism includes a shock absorber joined in parallel to the compression spring, are known. This additional shock absorber makes it possible to vary the release threshold of the front abutment with respect to the duration of the biasing. The threshold is elevated for brief biases and, on the other hand, is relatively weak for biases of long duration. This makes it possible to better adapt the response of the front abutment to the characteristics of mechanical resistance of the leg of a skier which can resist a bias of violent or elevated, but brief, intensity, whereas the leg can break in the case of a bias of weak intensity that is exerted during a fairly long period of time.

A front abutment which comprises a shock absorber joined to a compression spring forming part of the energization mechanism is described in German Patent No. 2,415,957 which includes, in one embodiment, a shock absorber which is coaxially mounted to the interior of the compression spring forming part of the energization mechanism. Such an arrangement is in fact preferable because it makes it possible to substantially reduce the bulk of the energization mechanism assembly. However, with such an arrangement, it is difficult to be able to adjust the stiffness of the energization spring, i.e., the initial rate of compression, without also modifying the initial length of the shock absorber at rest. With such a construction, it is necessary that the maximum course of compression of the shock absorber be at least equal to the sum of the compression course of the energization spring corresponding to the release of the binding and the compression course of the spring corresponding to the distance for adjustment of the stiffness of the spring. Another disadvantage of this type of front abutment is that it does not permit limiting the increase of the value of the release threshold in the case of a brief and intense bias which leads to the blocking of the shock absorber.

SUMMARY OF THE INVENTION

In view of the above, the present invention is directed to a safety ski binding adapted to hold a ski boot on a ski, which includes a body, a jaw mounted on a rear part of the body for retaining the ski boot on the ski in a locked position and releasing the ski boot when in a released position. The energization mechanism of the binding, for biasing the jaw towards the locked position, includes a force transmission element cooperating with the jaw. An adjustment nut adjusts the stiffness of the binding, and a spring rests at one end on the force transmission element and at the other end on the adjustment nut. The binding also includes means for adjusting the position of the adjustment nut.

According to a particular aspect of the invention, a shock absorber is positioned within the spring. A first end of the shock absorber is connected to a front portion of the force transmission element and the second end of the shock absorber is able to pass through an opening in a rear part of the adjustment nut. A linkage mechanism contacts the second end of the shock absorber and a rear portion of the means for adjusting the position of the adjustment nut so as to transfer the rearward displacement of the shock absorber when the shock absorber is subjected to a violent bias to a forward movement of the means for adjusting to cause additional compression of the spring.

According to a preferred embodiment of the invention, the means for adjusting the position of the adjustment nut may comprise a stiffness adjustment screw having front and rear ends and being threadably engaged with a portion of the adjustment nut, with the front end extending through a hole in the body.

Further according to a particular embodiment of the invention, the linkage mechanism may comprise a rocking device which is journalled on the body about a horizontal and transverse axis. The lower portion of the rocking device rests on the rear end of the shock absorber and the upper portion rests on the rear end of the adjustment screw. The adjustment screw includes a threaded rod and an abutment of greater diameter than that of the threaded rod at the rear. The rocking device includes a clevis having two lateral and vertical wings which are drilled with coaxial holes to receive the journal axis and a member connecting the two wings. The member is deformed in its central part to form a lower boss and an upper boss for contacting the rear end of the shock absorber and the rear end of the adjustment screw, respectively.

According to another aspect of the invention, the force transmission element comprises a tie rod having a substantially U-shape which is open towards the rear of the binding. The tie rod includes a front transverse member and first and second lateral arms extending from the front transverse member towards the rear of the binding. The spring is located between the first and second lateral arms. The jaw may include first and second retention wings for retaining the front of a ski boot The first and second lateral arms each include an abutment at its rear end to contact a respective first and second retention wing.

Still further according to the invention, the shock absorber comprises a shock absorber body which is closed by a rear wall, which is of a smaller size than the opening in the rear part of the adjustment nut. The shock absorber body contains a piston and a fluid. The piston includes at least one hole to permit the passage of the fluid and a piston rod extending from the piston towards the front of the binding. The front transverse member of the tie rod includes an opening and the shock absorber body includes a front part which is smaller than the opening so as to permit the front part to pass through the opening during movement of the tie rod towards the rear of the binding. The piston rod is in contact with a transverse pin extending between the first and second lateral arms. The spring also rests against the transverse pin.

According to another embodiment of the invention, the front end of the piston rod is connected to the transverse member of the tie rod. The spring also rests against the front transverse member of the tie rod.

According to a still further embodiment, the shock absorber comprises a shock absorber body which is closed at one end. The closed end abuts the front transverse member of the tie rod, and a piston rod extends towards the rear of the binding and contacts the linkage means. The spring also rests against the front transverse member of the tie rod.

According to another aspect of the invention, the adjustment nut includes a lower hollow section having a rear wall and an upper projection having a threaded hole. The spring is located in the lower hollow section and rests against the rear wall and the stiffness adjustment screw is engaged in the threaded hole.

The safety ski binding according to the invention can be further defined as including a body, a jaw mounted on a rear part of the body, which retains the ski boot on the ski in a locked position and releases the ski boot when in a released position. An energization mechanism biases the jaw towards the locked position and includes a force transmission element cooperating with the jaw, an adjustment nut for adjusting the stiffness of the binding and a spring cooperating with the force transmission element and the adjustment nut to bias the jaw towards the locked position, and means for adjusting the position of the adjustment nut.

Further, a shock absorber is positioned in the body and includes a first and second end. The first end is connected to the force transmission element. The shock absorber includes a piston and a fluid. The piston includes at least one hole to permit the passage of the fluid when a bias is weak and does not allow the passage of the fluid when a bias is violent so that the shock absorber moves relative to the adjustment nut. Linkage means transfers the movement of the shock absorber during a violent bias to movement of the means for adjusting to cause additional compression of the spring. The shock absorber may be located within the spring.

BRIEF DESCRIPTION OF THE DRAWINGS

The invention is further explained in the description which follows with reference to the drawings illustrating, by way of non-limiting examples, various embodiments of the invention, wherein:

FIG. 3 is a horizontal sectional view of the safety ski binding of FIG. 1, taken along line III—III of FIG. 1;

FIG. 4 is a vertical and longitudinal sectional view of the binding when its jaw is subjected to a weak bias;

FIG. 5 is a vertical and longitudinal sectional view of the binding when its jaw is subjected to a violent bias;

DETAILED DESCRIPTION OF THE PREFERRED EMBODIMENTS

It is an object of the present invention to overcome the disadvantages mentioned above with regard to known bindings by a simple construction making it possible to obtain an initial length of the shock absorber which is constant and independent of the initial compression of the spring, and a limitation of the force of the spring generated because of a resistant force of the shock absorber The safety ski binding according to the invention is adapted to hold the front of a boot on the ski, and comprises a body which supports at its rear part a jaw for retention of the front of the boot and which includes an energization mechanism for the retention jaw. The energization mechanism includes a longitudinal compression spring which rests at one end on a force transmission element which is coupled to the jaw and, at its other end, on a nut for adjustment of the stiffness of the binding which is adjustable at different longitudinal positions by means of a stiffness adjustment screw. A longitudinal shock absorber is lodged in the compression spring, and the compression spring is engaged in a lower hollow part of the stiffness adjustment nut which is open at its front end. The spring rests, at its rear end, on a rear frontal wall of the nut around an opening formed in the wall, and it rests at its front end on the force transmission element constituted by a longitudinal tie rod. The stiffness adjustment screw extends longitudinally above the spring and is screwed into an upper projecting part of the stiffness adjustment nut and rests, through its front head on a wall of the body which is penetrated by the adjustment screw. The longitudinal shock absorber, which is lodged within the compression spring, is connected at its front end to an extreme front part of the longitudinal tie rod and extends at its rear part in the opening provided in the rear wall of the stiffness adjustment nut. Linkage means are provided between the rear end of the shock absorber through the opening of the stiffness adjustment nut and the rear end of the stiffness adjustment screw so as to transfer the rearward displacement of the shock absorber in its entirety, in case of a violent bias, to a frontward movement of the stiffness adjustment nut, which causes additional compression of the spring.

Figure 1:
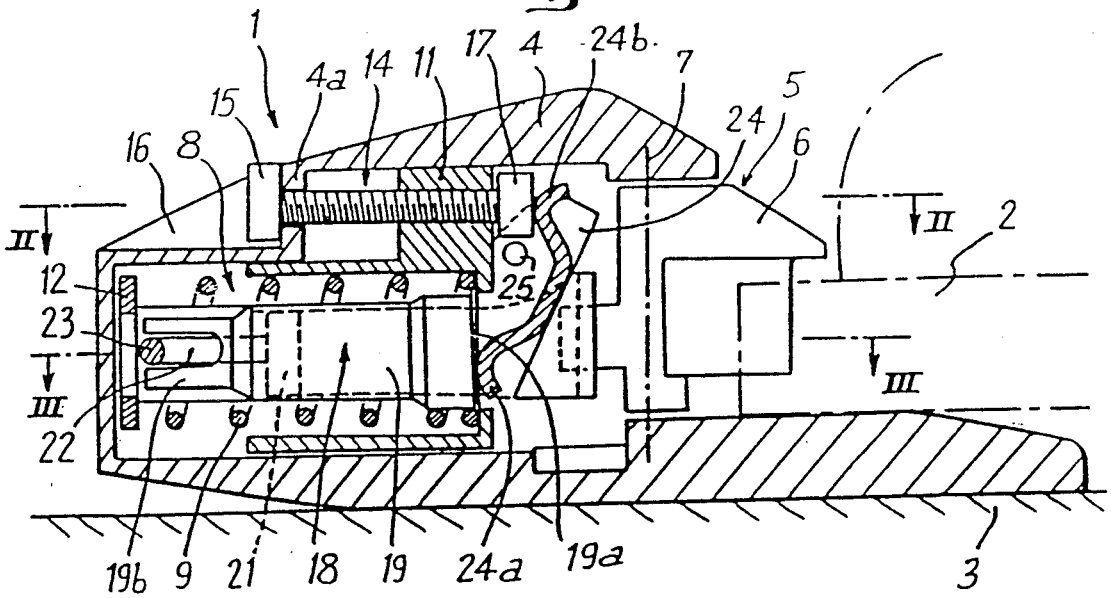
FIG. 1 is a vertical and longitudinal sectional view of a safety ski binding according to the invention in the locked position.
Figure 2:
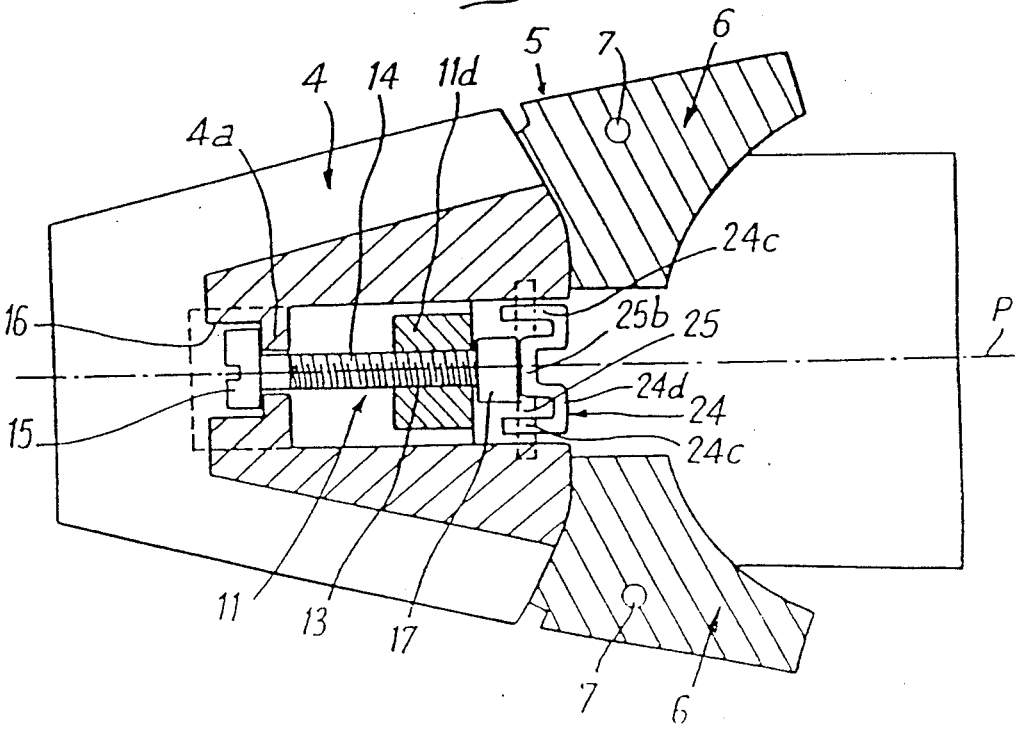
FIG. 2 is a horizontal sectional view of the safety ski binding of FIG. 1, taken along line II—II of FIG. 1.

With reference to the drawings, the safety binding or "front abutment" 1, according to the invention, is adapted to hold the front of boot 2 on ski 3. Front abutment 1 comprises body 4, which is affixed to the ski by means of screws, and which supports, in its rear part, jaw 5 for retention of the front of boot 2. Jaw 5 can be monoblock or, as is shown in FIG. 1, it can be constituted by two individual lateral retention wings 6 which are respectively journalled on body 4 about axes 7. Moreover, body 4 contains mechanism 8 for energization of the retention jaw 5. Mechanism 8 includes compression spring 9 which extends longitudinally in a housing of body 4 and which rests, at its rear end, on stiffness adjustment nut 11 and, at its front end, on force transmission element 12, which forms a longitudinal tie rod, by means of horizontal and transverse pin 23 located at the front end of the tie rod. Stiffness adjustment nut 11 includes lower hollow part 11*a*, of a cylindrical or prismatic shape, which is open at its front end and is partially sealed at its rear end by vertical and transverse wall 11*b* of nut which includes opening 11*c*. Compression spring 9 is located in lower hollow part 11*a* and rests against the internal surface of rear vertical wall 11*b* around opening 11*c*. The stiffness adjustment nut 11 also includes an upper and rear part 11*d* of smaller width than lower part 11*a* and which constitutes a projection bored through by longitudinally tapped, or threaded, hole 13. Stiffness adjustment screw 14 extends longitudinally through hole 13 and above spring 9 and includes front head 15 which is located in space 16 which is formed in the front and upper part of body 4. Front head 15 of stiffness adjustment screw 14 is located outside the body and rests against vertical and transverse wall 4*a* which is provided in the upper part of body 4 and which is provided with a hole through which the rod of screw 14 extends. At its rear end, screw 14 is solidly affixed to transverse abutment 17 of greater diameter than that of the rod of screw 14.

Figure 9:
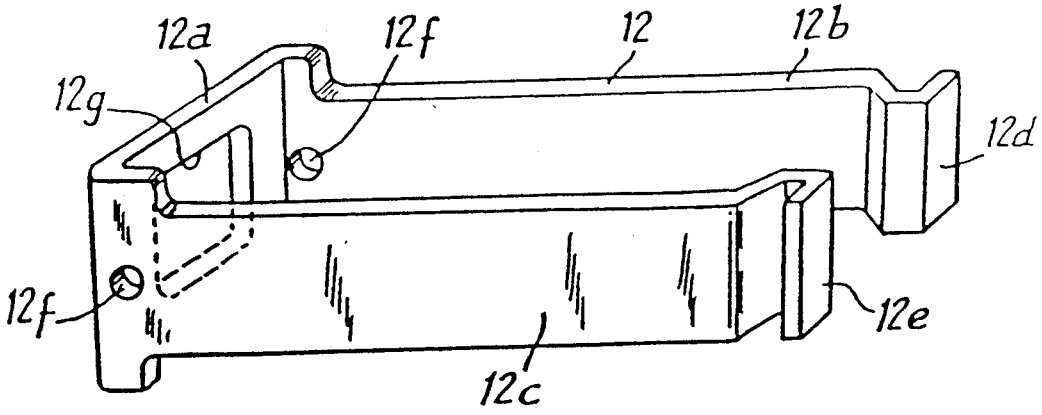
FIG. 9 is a perspective view of the tie rod of the energization mechanism.

Tie rod 12, shown in detail in FIG. 9, is substantially U-shaped in plan view and is open towards the rear. It includes front vertical and transverse member 12*a*, having two longitudinal and vertical lateral arms 12*b*, 12*c* which extend towards the rear of the binding. Compression spring 9 rests, at its front end, against pin 23, which is located near the internal surface of front transverse member 12*a* of tie rod 12 and which extends through openings 12*f* in arms 12*b*, 12*c*. At their rear ends, the lateral arms 12*b*, 12*c* of tie rod 12 include abutments 12*d*, 12*e* which project towards the exterior The abutments are formed, for example, by respective curved lugs in the form of hooks which are open towards the exterior. Lugs 12*d*, 12*e* respectively contact the ends of short front transverse arms 6*a* which form part of lateral retention wings 6 and extend from journal axes 7 of the wings in the direction of the vertical and longitudinal plane of symmetry P of the front abutment. By this construction, compression spring 9, which is compressed between the stiffness adjustment nut 11 and pin 23 of tie rod 12, constantly biases tie rod 12 towards the front. Tie rod 12 acts in turn on the front transverse arms 6*a* of the two lateral retention wings 6 to bias the rear arms 6*b* of these wings towards one another and in contact with the sole of the boot. Nut 11 is itself biased towards the rear by compression spring 9 and is retained in this direction because stiffness adjustment screw 14, which is solidly affixed to nut 11, rests, by its front head 15, against wall 4*a* of body 4.

Energization mechanism 8 of front abutment 1, according to the invention, also includes hydraulic shock absorber 18, which extends longitudinally and which is lodged within compression spring 9. Shock absorber 18 comprises cylindrical body 19 which is closed by rear frontal wall 19*a* and part 19*b* of smaller diameter which extends towards the front of the binding. Piston 21 is lodged within body 19 of shock absorber 18 and is provided with at least one hole extending completely therethrough to permit the passage of a fluid, such as a liquid for filling body 19 between the two chambers defined within this body by piston 21. Piston 21 is solidly affixed to axial piston rod 22 which extends towards the front through part of smaller diameter 19*b* and includes an end which is in contact with the horizontal and transverse pin 23 which extends between the two lateral arms 12*b*, 12*c* of tie rod 12. Pin 23 transmits to piston rod 22 the compression movements of spring 9 which are generated by the displacement of tie rod 12. Transverse member 12*a* of tie rod 12 is also provided with an opening 12*g* which is positioned to face part 19*b* of body 19 and is of a dimension greater than part 19*b* so as to permit part 19*b* to be able to go through opening 12*g* during longitudinal sliding movement of tie rod 12 towards the rear of the binding.

Rear wall 19*a* of body 19 of shock absorber 18 is in contact with a lower boss 24*a* on the lower arm of rocking device 24 which is journalled, in its upper part, about horizontal and transverse axis 25 supported by body 4. Rocking device 24 includes upper boss 24*b* which is in contact with abutment 17 provided at the rear end of stiffness adjustment screw 14.

Rocking device 24 is preferably in the form of a clevis comprising two lateral and vertical wings 24*c*, which are provided with coaxial holes for the passage of journal axis 25 and member 24*d* connecting the two wings 24*c*. Member 24*d* is deformed in its central part so as to form lower boss 24*a* and upper boss 24*b* with convexity facing towards the front of the binding. Rocking device 24 thus constitutes a force transmission lever between body 19 of shock absorber 18 and stiffness adjustment screw 14, the amount of transmission being dependent on the position of axis 25 on rocking device 24.

When the sole of boot 2 exerts a bias towards the exterior on one of the lateral retention wings 6, because of a twisting of the skier's leg, the respective retention wing pivots about its journal axis 7 and its front transverse arm 6*a* causes a movement of tie rod 12 towards the rear against compression spring 9. This spring then compresses over a certain distance and the opposing force that it exerts on wing 6 increases. In the course of the recoil movement of tie rod 12, the piston rod 22 and the piston 21 moves towards the interior of body 19 of shock absorber 18 by means of pin 23.

If the bias exerted is "weak", the movement of the bored piston 21 within body 19 of shock absorber 18 is sufficiently slow so the shock absorber fluid contained in body 19 passes from one chamber through the holes in the piston to the other chamber without opposing the movement of piston 21. Shock absorber 18 thus retracts without strong resistance and, consequently, body 19 does not move. As a result, rocking device 24, stiffness adjustment screw 14, and adjustment nut 11 remain immovable. This corresponds to the position illustrated in FIG. 4 where it is seen that the recoil of tie rod 12 towards the rear over a distance a is translated by the compression of spring 9 over this same distance and in this case, shock absorber 18 does not exert any influence on the release threshold of the binding.

On the other hand, if the bias exerted is violent, as depicted in FIG. 5, i.e., at a high intensity during a very short time, the recoil movement of tie rod 12 is transmitted to piston 21 which then tends to move rapidly towards the rear within body 19. However, its movement within body 19 is prevented because of the viscous nature of the shock absorber fluid, so that shock absorber 18 "stiffens" and tie rod 12 then moves the assembly of shock absorber 18 towards the rear by pin 23. Body 19 then recoils a predetermined distance and in the course of this movement, the rear frontal surface 19*a*, which is in contact with the lower boss 24*a* of rocking device 24 through opening 11*c* provided in the lower part of rear frontal surface 11*b* of adjustment nut 11, causes a rotation of rocking device 24 about axis 25, in a counter-clockwise direction. Because of this movement, upper boss 24*b* of rocking device 24 is displaced towards the front and as it rests against abutment 17, it pushes the stiffness adjustment screw 14 and the stiffness adjustment nut 11 which is solidly affixed thereto towards the front of the binding. Because of this movement, the exterior head 15 of the stiffness adjustment screw 14 separates somewhat towards the front of wall 4*a* of body 4 as can be seen in FIG. 5. The frontward movement of stiffness adjustment nut 11 over a distance b (FIG. 5) is translated to an additional compression of compression spring 9 and, consequently, an increase of the release threshold of the binding.

Figure 6:
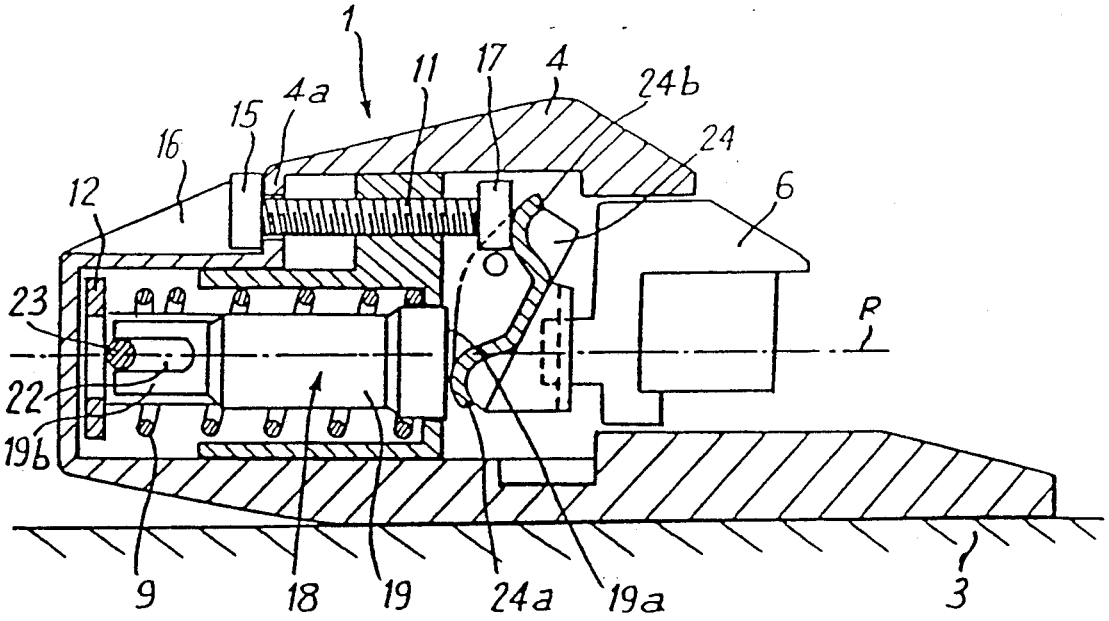
FIG. 6 is a vertical and longitudinal sectional view of the binding whose stiffness adjustment nut is at a longitudinal position different from that shown in FIG. 1.
Figure 7:
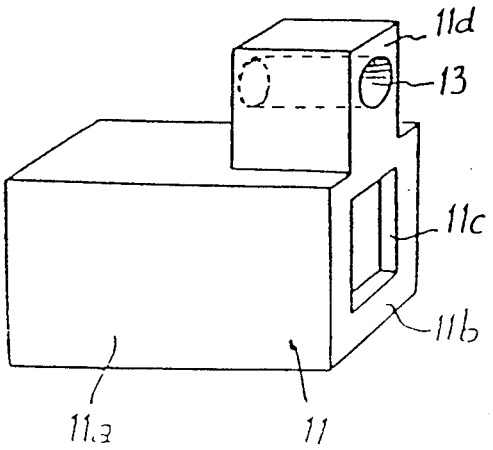
FIG. 7 is a perspective view of the stiffness adjustment nut.
Figure 8:
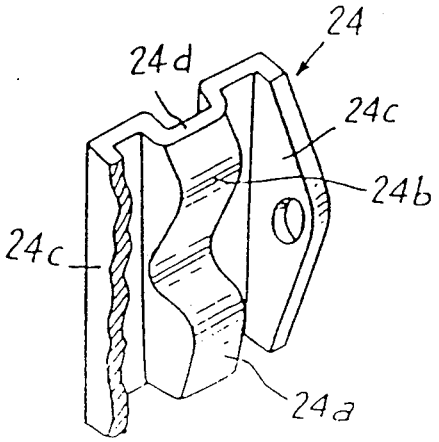
FIG. 8 is a partial perspective view of the rocking device.

FIG. 6 illustrates the manner in which the stiffness of the binding is adjusted. As indicated previously, compression spring 9 pushes the stiffness adjustment nut 11 to which stiffness adjustment screw 14 is solidly affixed towards the rear and, as a result, the external head 15 of this screw is continuously biased towards the rear and is maintained pressed against wall 4*a* of body 4. Rotation in the appropriate direction of screw 14, for example, by means of a screwdriver engaged in head 15, causes translation of the stiffness adjustment nut 11 towards the front, thus causing an increase in the initial rate of compression of spring 9, and consequently of the stiffness of the binding, i.e., of the release threshold thereof. During the adjustment of stiffness, rocking device 24 and shock absorber 18 do not move, and upper boss 24*b* of rocking device 24 still rests against abutment 17 provided at the internal end of stiffness adjustment screw 14 which does not move longitudinally.

Figure 10:
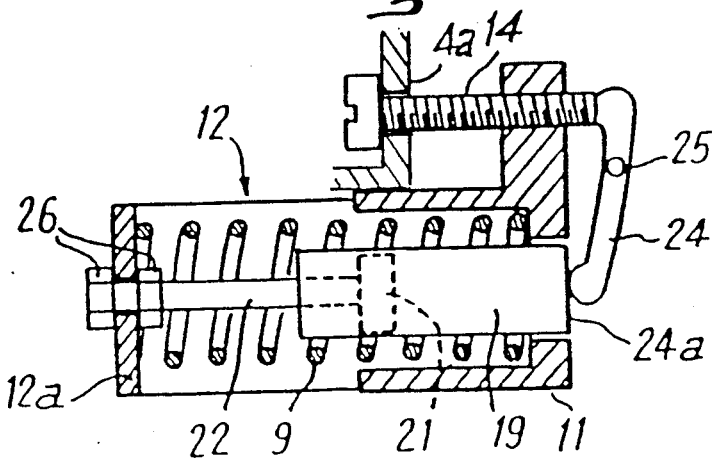
FIGS. 10 and 11 are partial schematic longitudinal and vertical sectional views of alternative embodiments of the safety binding.
Figure 11:
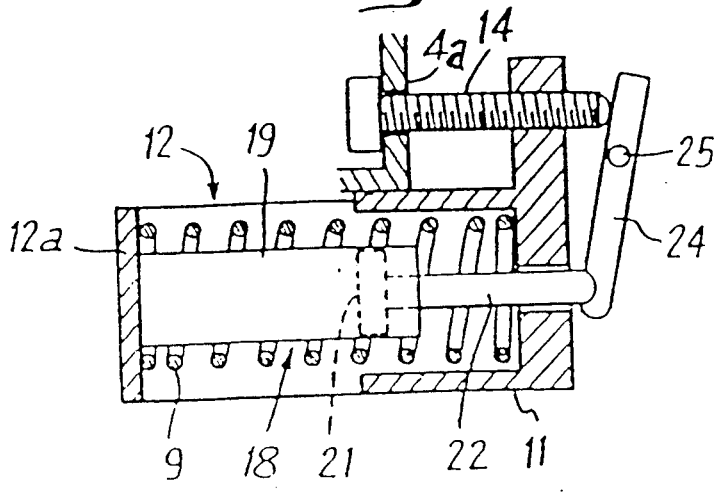

Various embodiments of the safety binding according to the invention are possible, as is shown, for example, in FIGS. 10 and 11.

In the alternative embodiment shown in FIG. 10, piston rod 22 of shock absorber 18, which extends towards the front, is directly affixed at its end to member 12*a* of tie rod 12, for example, by means of nuts 26. Moreover, compression spring 9 rests directly at its front end against the internal surface of member 12*a* of tie rod 12.

In the alternative embodiment shown in FIG. 11, shock absorber 18 is mounted in a reversed position to that previously illustrated. That is, body 19 of the shock absorber faces towards the front and it rests through its front surface against the internal surface of front transverse member 12*a* of tie rod 12. Its piston rod 22 extends towards the rear and it rests at its rear end against the lower arm of rocking device 24. Again, spring 9 rests directly against member 12*a* of tie rod 12.

Although the invention has been described with reference to particular means, materials and embodiments, it is to be understood that the invention is not limited to the particulars disclosed and extends to all equivalents within the scope of the claims.

We claim:

1. A safety ski binding having a front and rear and being adapted to hold a ski boot on a ski, said safety ski binding comprising:

a) a body;

b) a jaw movably mounted on a rear part of said body, said movable jaw retaining the ski boot on the ski in a first locked position and releasing the ski boot when in a second released position;

c) an energization mechanism exerting a biasing force for biasing said jaw towards said locked position, said energization mechanism including a force transmission element cooperating with said jaw, an adjustment nut being movable to different positions for adjusting the biasing force, and a spring resting at one end on said adjustment nut;

d) means for adjusting the position of said adjustment nut;

e) a shock absorber positioned within said spring, said shock absorber having a first end and a second end, said first end of said shock absorber being connected to a front portion of said force transmission element, the second end of said shock absorber adapted to extend through an opening in a rear part of said adjustment nut; and f) movable linkage means for contacting both the second end of said shock absorber and a rear portion of said means for adjusting the position of said adjustment nut so as to transfer rearward displacement of said shock absorber when said shock absorber is subjected to a violent bias to a forward movement of said means for adjusting to cause additional compression of said spring.

2. The safety ski binding according to claim 1, wherein said means for adjusting the position of said adjustment nut comprises a stiffness adjustment screw having front and rear ends and being threadably engaged with a portion of said adjustment nut, said front end extending through a hole in said body.

3. The safety ski binding according to claim 2, wherein said linkage means comprises a rocking device having a lower portion and an upper portion, said rocking device being journalled on said body about a horizontal and transverse axis, said lower portion resting on the second end of said shock absorber and said upper portion resting on the rear end of said stiffness adjustment screw.

4. The safety ski binding according to claim 3, wherein said stiffness adjustment screw comprises a threaded rod, the rear end of said stiffness adjustment screw including an abutment of greater diameter than that of said threaded rod.

5. The safety ski binding according to claim 3, wherein said rocking device comprises a clevis having two lateral and vertical wings which include coaxial holes to receive said journal axis and a member connecting said two wings, said member being deformed in a central part to form a lower boss and an upper boss, said lower boss and said upper boss being in contact with the rear end of said shock absorber and the rear end of said adjustment screw, respectively.

6. The safety ski binding according to claim 1, wherein said force transmission element comprises a tie rod having a substantially U-shape which is open towards the rear of the binding, said tie rod including a front transverse member and first and second lateral arms extending from said front transverse member towards the rear of the binding, said spring being between said first and second lateral arms.

7. The safety ski binding according to claim 6, wherein said jaw includes a first and second retention wings for retaining a ski boot, said first and second lateral arms each including a rear end and an abutment at said rear end to contact a respective first and second retention wing.

8. The safety ski binding according to claim 6, wherein said shock absorber comprises a shock absorber body which is closed by a rear wall, said rear wall being of a smaller size than said opening in said rear part of said adjustment nut, said shock absorber body containing a piston and a fluid, and a piston rod extending from said piston towards the front of said binding.

9. The safety ski binding according to claim 8, wherein said front transverse member of said tie rod includes an opening, said shock absorber body including a front part, said front part being smaller than said opening in said front transverse member so as to permit said front part to pass through said opening during movement of said tie rod towards the rear of the binding.

10. The safety ski binding according to claim 8, further comprising a transverse pin extending between said first and second lateral arms, said piston rod being in contact with said transverse pin.

11. The safety ski binding according to claim 10, wherein said spring rests against said transverse pin.

12. The safety ski binding according to claim 6, further comprising a transverse pin extending between said first and second lateral arms, said spring resting against said transverse pin.

13. The safety ski binding according to claim 8, wherein said first end of said piston rod is connected to said front transverse member of said tie rod.

14. The safety ski binding according to claim 13, wherein said spring rests against said front transverse member of said tie rod.

15. The safety ski binding according to claim 6, wherein said shock absorber comprises a shock absorber body which is closed at one end, said one end abutting said front transverse member of said tie rod, and a piston rod extending towards the rear of said binding and contacting said linkage means.

16. The safety ski binding according to claim 15, wherein said spring rests against said front transverse member of said tie rod.

17. The safety ski binding according to claim 2, wherein said adjustment nut includes a lower hollow section having a rear wall and an upper projection having a threaded hole, said spring being located in said lower hollow section and resting against said rear wall, and said stiffness adjustment screw being engaged in said threaded hole.

18. A safety ski binding having a front and rear and being adapted to hold a ski boot on a ski, said safety ski binding comprising:

a) a body;

b) a jaw movably mounted on a rear part of said body, for retaining the ski boot on the ski in a first locked position and releasing the ski boot when in a second released position;

c) a tie rod movable within said body and cooperating with said jaw to allow said jaw to move to said second released position and to return to said first locked position;

d) an adjustment nut movable to different positions relative to said tie rod, a spring located between and cooperating with said tie rod and said adjustment nut to bias said jaw toward said locked position;

e) means for adjusting the position of said adjustment nut;

f) a shock absorber positioned within said spring, said shock absorber having a first and second end, said first end of said shock absorber being connected to said tie rod; and g) movable linkage means for contacting both the second end of said shock absorber and said means for adjusting so as to transfer displacement of said shock absorber during a violent bias to movement of said means for adjusting to cause additional compression of said spring.

19. The safety ski binding according to claim 18, wherein said adjustment nut includes a lower hollow section having a rear wall and an upper projection having a threaded hole, said spring being located in said lower hollow section and resting against said rear wall, said means for adjustment comprising a stiffness adjustment screw having front and rear ends, said stiffness adjustment screw being engaged in said threaded hole, and said front end extending through a hole in said body.

20. The safety ski binding according to claim 19, wherein said linkage means comprises a rocking device having a lower portion and an upper portion, said rocking device being journalled on said body, said lower portion contacting the second end of said shock absorber and said upper portion contacting the rear end of said adjustment screw.

21. The safety ski binding according to claim 18, wherein said tie rod includes a front transverse member and first and second lateral arms extending from said front transverse member towards the rear of the binding, said spring being between said first and second lateral arms.

22. The safety ski binding according to claim 18, wherein said shock absorber is closed at one end and includes a piston and a fluid.

23. The safety ski binding according to claim 22, wherein said adjustment nut includes a rear wall having an opening, the closed end of said shock absorber being movable through said opening to move said linkage means.

* * * * *